US009829825B2

(12) United States Patent
Fujihara

(10) Patent No.: US 9,829,825 B2
(45) Date of Patent: Nov. 28, 2017

(54) IMAGE FORMING APPARATUS

(71) Applicant: KYOCERA Document Solutions Inc., Osaka (JP)

(72) Inventor: Kensuke Fujihara, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 15/367,166

(22) Filed: Dec. 1, 2016

(65) Prior Publication Data

US 2017/0160668 A1 Jun. 8, 2017

(30) Foreign Application Priority Data

Dec. 4, 2015 (JP) ..... 2015-237290

(51) Int. Cl.
*G03G 15/06* (2006.01)

(52) U.S. Cl.
CPC ..... *G03G 15/065* (2013.01)

(58) Field of Classification Search
None
See application file for complete search history.

(56) References Cited

U.S. PATENT DOCUMENTS

2004/0018024 A1* 1/2004 Lee ..... G03G 15/065 399/38
2010/0129102 A1* 5/2010 Fujihara ..... G03G 15/065 399/55
2011/0158664 A1* 6/2011 Hotomi ..... G03G 15/0216 399/43
2014/0321869 A1* 10/2014 Fujihara ..... G03G 15/0907 399/55
2015/0261124 A1* 9/2015 Ikazaki ..... G03G 15/065 399/55

FOREIGN PATENT DOCUMENTS

JP 2005-258309 9/2005

* cited by examiner

*Primary Examiner* — Thomas Giampaolo, II

(57) ABSTRACT

A controller (a) increases a development bias when a surface potential of the photoconductor drum is 0 Volt, and determines a level of the development bias as a discharge voltage at a timing when discharge is detected between a photoconductor drum and a developing roller, (b) sets an alternating current component of the development bias so as to make a lowest level of the development bias equal to a level lower by the discharge voltage than a desired surface potential of the photoconductor drum, and (c) increases an applied voltage to a charging roller (that charges a surface of the photoconductor drum) when applying to the developing roller the development bias of which the alternating current component has been set, and determines as an applied voltage to the charging roller corresponding to the desired surface potential, the applied voltage at a timing when the discharge is detected.

4 Claims, 6 Drawing Sheets

IMAGE FORMING APPARATUS

CROSS-REFERENCE TO RELATED APPLICATIONS

This application relates to and claims priority rights from Japanese Patent Application No. 2015-237290, filed on Dec. 4, 2015, the entire disclosures of which are hereby incorporated by reference herein.

BACKGROUND

1. Field of the Present Disclosure

The present disclosure relates to an image forming apparatus.

2. Description of the Related Art

An electrophotographic development system charges a surface of a photoconductor drum using a charging roller. Such process may apply to the charging roller (a) a charging voltage obtained by adding a direct current voltage and an alternating current to each other or (b) a direct current voltage as a charging voltage.

When charging a charging voltage obtained by adding a direct current voltage and an alternating current to each other to the charging roller, a surface potential of the photoconductor drum is set as a desired potential by detecting a current that flows into the charging roller and adjusting the detected current.

A characteristic of the photoconductor drum varies due to aging of the photoconductor drum, an environmental condition (machine outer temperature, machine outer humidity and/or the like), a usage situation (continuous usage time by now, the number of continuous printing paper sheets, and/or the like), and the like, and thereby the flowing current into the charging roller is changed to set the surface potential of the photo conductor drum as a desired potential, and consequently it is difficult to properly set the surface potential of the photoconductor drum on the basis of the flowing current and the like.

It should be noted that it is possible to properly set the surface potential of the photoconductor drum using a surface potential sensor, but such surface potential sensor is costly and therefore if such surface potential sensor is installed then the image forming apparatus is also costly.

SUMMARY

An image forming apparatus according to an aspect of the present disclosure includes a photoconductor drum; a charging roller configured to charge a surface of the photoconductor drum; a developing roller; a charge power supply circuit configured to apply a direct current voltage to the charging roller; a development bias power supply circuit configured to apply a development bias to the developing roller; and a controller configured to control the charge power supply circuit and the development bias power supply circuit. The controller (a) increases the development bias using the development bias power supply circuit when a surface potential of the photoconductor drum is 0 Volt, and determines a level of the development bias as a discharge voltage at a timing when discharge is detected between the photoconductor drum and the developing roller, (b) sets an alternating current component of the development bias using the development bias power supply circuit so as to make a lowest level of the development bias equal to a level lower by the discharge voltage than a desired surface potential of the photoconductor drum, and (c) increases an applied voltage to the charging roller using the charge power supply circuit when applying to the developing roller the development bias of which the alternating current component has been set, and determines as an applied voltage to the charging roller corresponding to the desired surface potential, the applied voltage at a timing when discharge is detected between the photoconductor drum and the developing roller.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
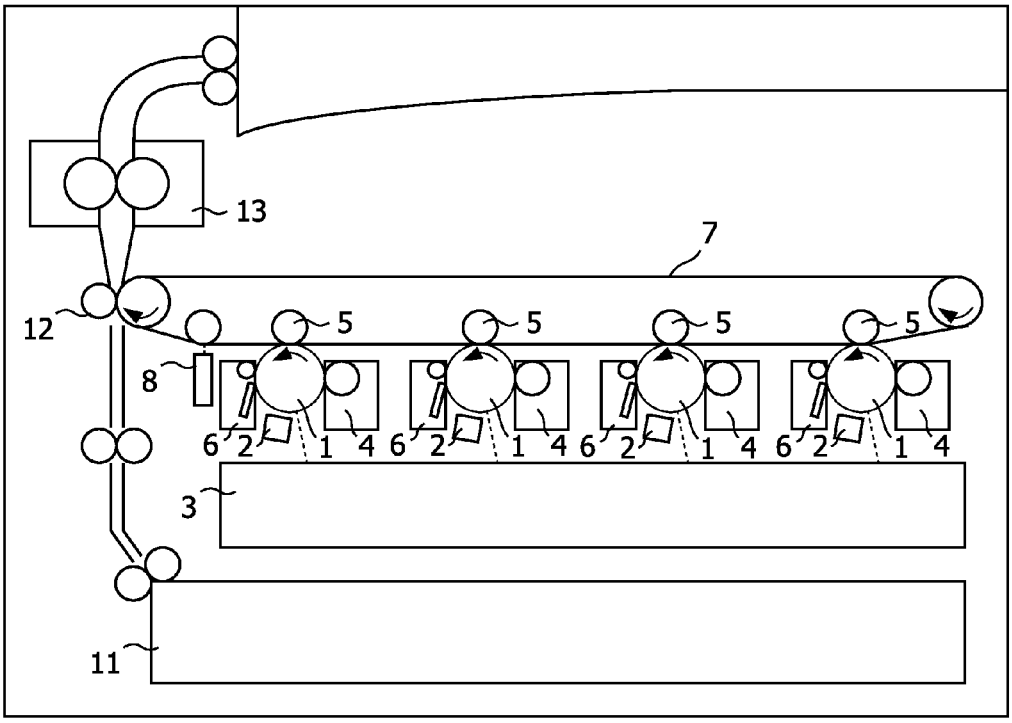
FIG. 1 shows a side view that indicates an internal mechanical configuration of an image forming apparatus in an embodiment according to the present disclosure.
Figure 2:
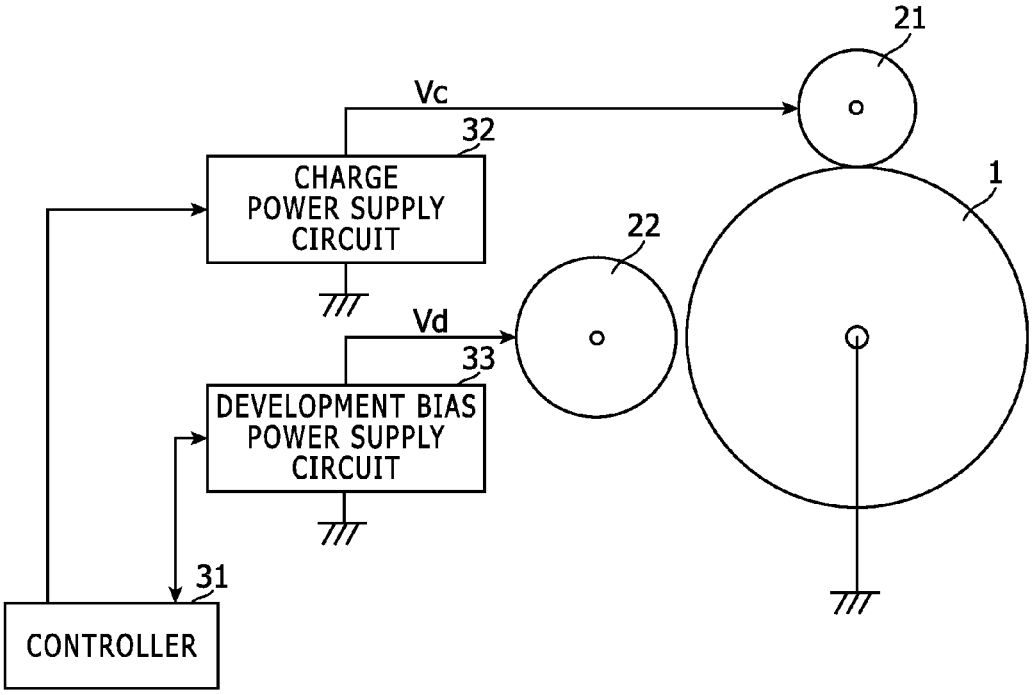
FIG. 2 shows a block diagram that indicates an electronic configuration of the image forming apparatus in the embodiment according to the present disclosure.

FIG. 1 shows a side view that indicates an internal mechanical configuration of an image forming apparatus in an embodiment according to the present disclosure. FIG. 2 shows a block diagram that indicates an electronic configuration of the image forming apparatus in the embodiment according to the present disclosure.

The image forming apparatus shown in FIGS. 1 and 2 is an apparatus having an electrophotographic printing function, such as a printer, a facsimile machine, a copier, or a multi function peripheral. The image forming apparatus in the present embodiment includes a tandem-type color development device. For each color of Cyan, Magenta, Yellow and Black, this color development device includes a photoconductor drum 1, a charging device 2, an exposure device 3, a development device 4, a transfer roller 5, a cleaning unit 6, and an unshown static electricity eliminator.

In FIG. 1, the photoconductor drum 1 is a cylindrically shaped photoconductor and image carrier that an electrostatic latent image is formed on a surface thereof by the exposure device 3. As the photoconductor drum 1, an inorganic photoconductor is used such as an amorphous silicon photoconductor.

The charging device 2 includes a charging roller 21 and charges a surface of the photoconductor drum 1 on the basis of a process condition using the charging roller 21.

The exposure device 3 is a device that irradiates laser light to the photoconductor drum 1 and thereby forms an electrostatic latent image. The exposure device 3 includes a laser diode as a light source of the laser light, and optical elements (such as lens, mirror and polygon mirror) that guide the laser light to the photoconductor drum 1.

The development device 4 includes a developing roller 22 made of a conductive material, and moves toner supplied from an unshown toner container from the developing roller 22 to the electrostatic latent image on the photoconductor drum 1 and thereby develops the electrostatic latent image with the toner and forms a toner image based on a process condition.

The transfer roller 5 transfers the toner image on the photo conductor drum 1 to an intermediate transfer belt 7. The cleaning unit 6 collects residual toner on the photoconductor drum 1 after the transfer of the toner image to the intermediate transfer belt 7. The intermediate transfer belt 7 is a loop-shaped intermediate transfer member that contacts the photoconductor drum 1, and onto which the toner image on the photoconductor drum 1 is transferred. The intermediate transfer belt 7 is hitched around a driving roller and the like, and rotates by driving force of the driving roller.

A density sensor 8 is a reflection type density sensor that irradiates light to the intermediate transfer belt 7 and detects its reflection light, and thereby detects a density of the toner image on the intermediate transfer belt 7.

A transfer roller 12 causes a paper sheet conveyed from a paper feeding unit 11 to contact the intermediate transfer belt 7, and transfers the toner image on the intermediate transfer belt 7 to the paper sheet. The paper sheet on which the toner image has been transferred is transported to a fuser unit 13 and the toner image is fixed.

In FIG. 2, a controller 31 is electronically connected to a driving circuit that drives a motor to actuate the photoconductor drum 1, the intermediate transfer belt 7 or the like, the density sensor 8, the charging device 2, the exposure device 3, the development device 4 and the like, and controls these components and thereby performs a print process that includes forming an electrostatic latent image and developing a toner image in accordance with a currently set process condition. The controller 31 is embodied using a processor such as a CPU (Central Processing Unit) or an MPU (Microprocessing Unit), an ASIC (Application Specific Integrated Circuit) and/or the like.

A charge power supply circuit 32 is a power supply circuit that applies a direct current voltage Vc specified by the controller 31 to the charging roller 21. The charge power supply circuit 32 does not apply an alternating current voltage to the charging roller 21.

A development bias power supply circuit 33 is a power supply circuit that applies a development bias Vd specified by the controller 31 to the developing roller 22. The development bias power supply circuit 33 applies to the developing roller 22 the development bias Vd obtained by adding a direct current voltage and an alternating current voltage (e.g. a square wave in this embodiment) specified by the controller 31 to each other.

The controller 31 controls the charge power supply circuit 32 and the development bias power supply circuit 33, and thereby (a) increases the development bias using the development bias power supply circuit 33 when a surface potential of the photoconductor drum 1 is 0 Volt, and determines a level of the development bias as a discharge voltage Vd0 when discharge is detected between the photoconductor drum 1 and the developing roller 22, (b) sets an alternating current component of the development bias using the development bias power supply circuit 33 so as to make a lowest level VdL of the development bias equal to a level lower by the discharge voltage Vd0 than a desired surface potential Vs of the photoconductor drum 1, and (c) increases an applied voltage to the charging roller 21 using the charge power supply circuit 32 when applying to the developing roller 22 the development bias of which the alternating current component has been set, and determines as an applied voltage Vc0 to the charging roller 21 corresponding to the desired surface potential Vs, the applied voltage Vc at a timing when discharge is detected between the photoconductor drum 1 and the developing roller 22.

For example, the controller 31 measures a conducting current between the development bias power supply circuit 33 and the developing roller 22 and detects the discharge between the photo conductor drum 1 and the developing roller on the basis of a measured value of the conducting current.

In the present embodiment, the controller 31 stepwisely increases a peak-to-peak value or a duty of an alternating current component of the development bias Vd at each time when the developing roller 22 rotates predetermined plural times (e.g. twice, but may be once), and determines a level of the development bias Vd as the discharge Vd0 voltage at a timing when discharge is detected predetermined plural times between the photoconductor drum 1 and the developing roller 22 in a period while the peak-to-peak value or the duty of the alternating current component of the development bias is set to be constant.

Further, in the present embodiment, the controller 31 stepwisely increases the applied voltage Vc to the charging roller 21 at each time when the developing roller 22 rotates predetermined plural times (e.g. twice, but may be once), and determines as the applied voltage Vc0 to the charging roller 22 corresponding to the desired surface potential Vs, the applied voltage Vc at a timing when discharge is detected predetermined plural times between the photoconductor drum 1 and the developing roller 22 in a period while the applied voltage Vc is set to be constant.

Furthermore, in the present embodiment, the controller sets a peak-to-peak value of the alternating current component of the development bias or a duty of the alternating current component of the development bias using the development bias power supply circuit 33 so as to make a lowest level VdL of the development bias equal to a level lower by a discharge voltage Vd0 than a desired surface potential Vs of the photoconductor drum 1.

When performing a print process for an image based on image data, the controller 31 applies the determined voltage to the charging roller 21 using the charge power supply circuit 32 and thereby sets a surface potential of the photoconductor drum 1 as a desired surface potential Vs. It should be noted that the development bias in a print process of an image based on image data is appropriately determined in accordance with a process condition.

Figure 3:
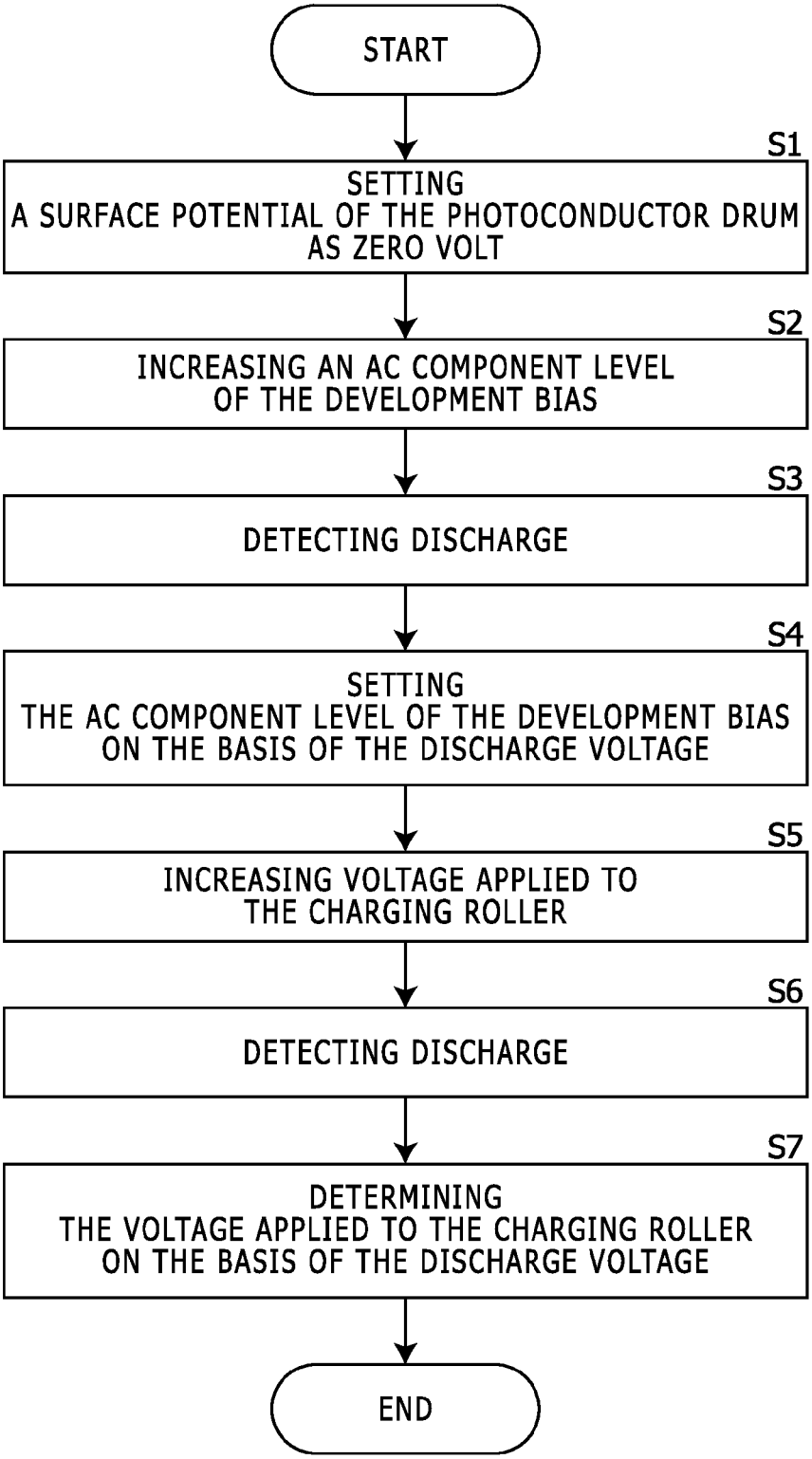
FIG. 3 shows a flowchart that explains a behavior of the image forming apparatus shown in FIGS. 1 and 2.

The following part explains a behavior of the aforementioned image forming apparatus for determining an applied voltage to the charging roller 21 so as to set a surface potential of the photoconductor drum 1 as a desired surface potential Vs. FIG. 3 shows a flowchart that explains a behavior of the image forming apparatus shown in FIGS. 1 and 2.

Figure 4:
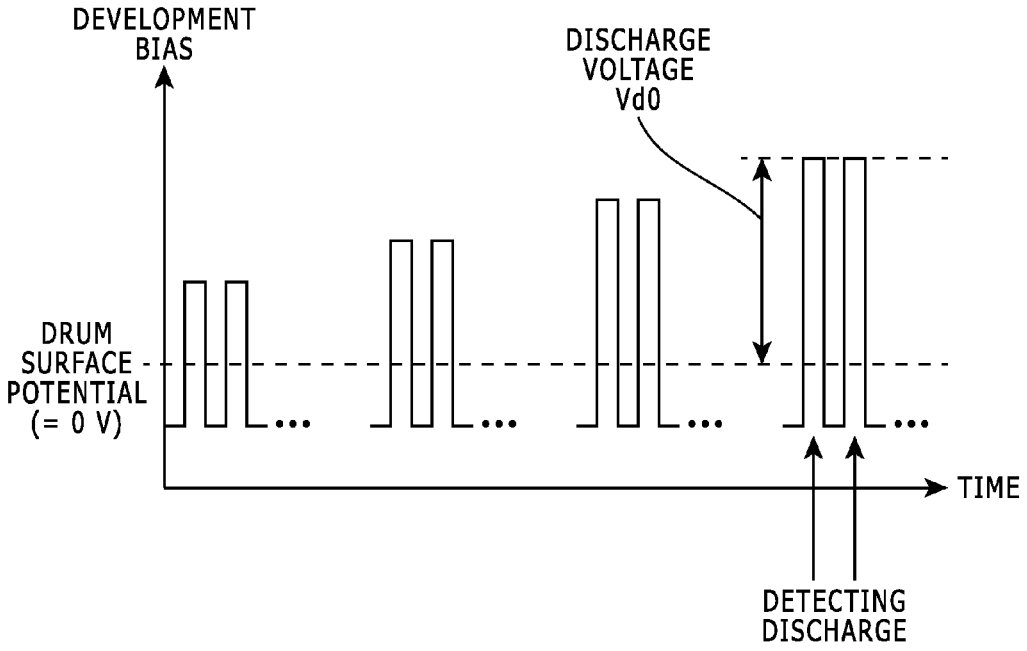
FIG. 4 is a timing chart that explains determination of a discharge voltage Vd0 in the image forming apparatus shown in FIGS. 1 and 2.

Firstly, the controller 31 determines a discharge voltage Vd0 between the photoconductor drum 1 and the developing roller 22 (in Steps S1 to S3). FIG. 4 is a timing chart that explains determination of a discharge voltage Vd0 in the image forming apparatus shown in FIGS. 1 and 2.

The controller 31 sets a surface potential of the photoconductor drum 1 as 0 Volt (i.e. a ground level) using the charge power supply circuit 32 (in Step S1).

Subsequently, the controller 31 increases the development bias Vd using the development bias power supply circuit 33 (in Step S2). For example, the controller 31 increases a peak-to-peak value of an alternating current component of the development bias Vd gradually from a predetermined value as shown in FIG. 4.

In this process, when detecting discharge between the photoconductor drum 1 and the developing roller 22, the controller 31 determines a level of the development bias Vd at a timing when the discharge is detected (i.e. a maximum value of the development bias wave form) as the discharge voltage Vd0 (in Step S3).

Figure 5:
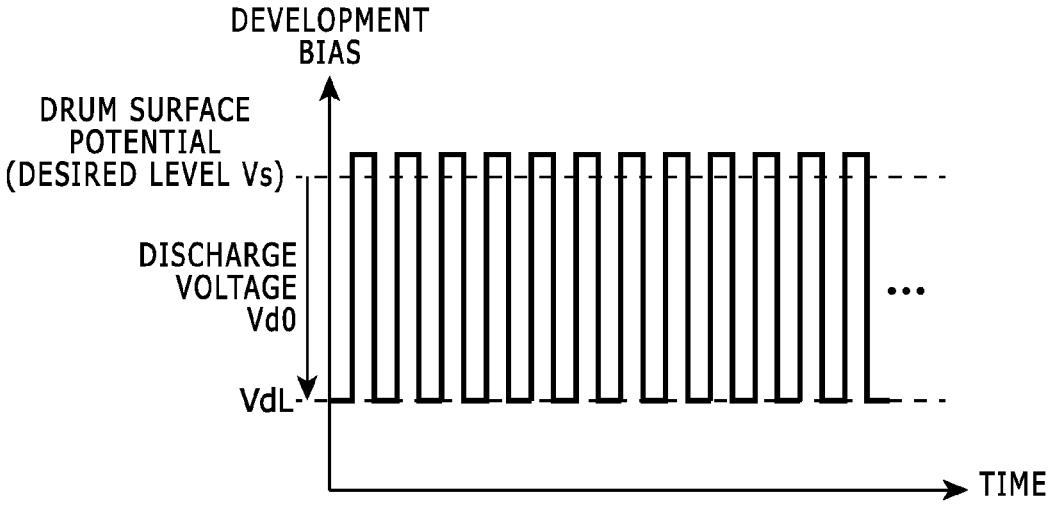
FIG. 5 is a timing chart that explains determination of an applied voltage to a charging roller 21 corresponding to a desired surface potential Vs of the photoconductor drum in the image forming apparatus shown in FIGS. 1 and 2 (1/2)
Figure 6:
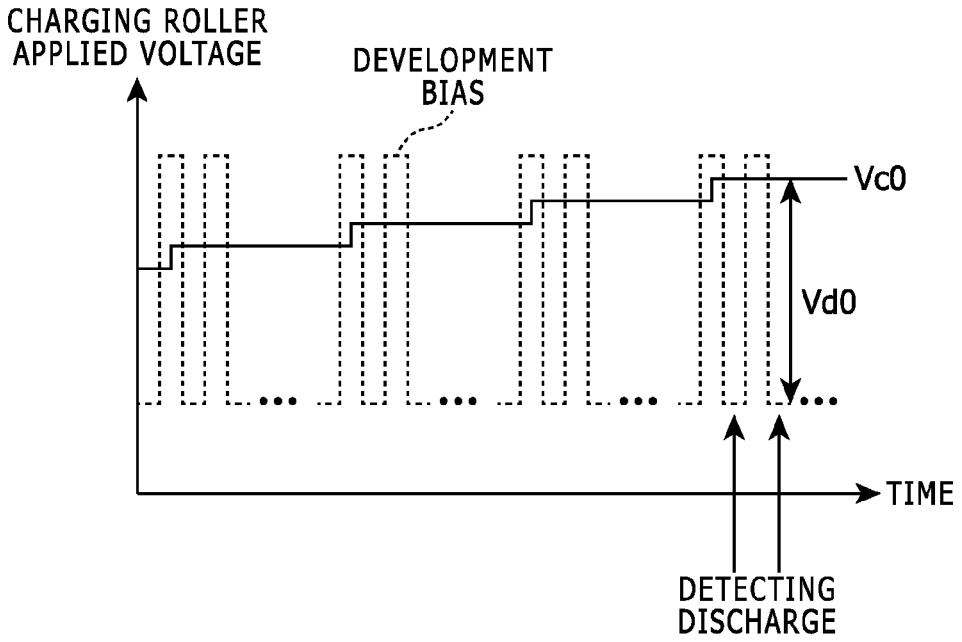
FIG. 6 is a timing chart that explains determination of an applied voltage to a charging roller 21 corresponding to a desired surface potential Vs of the photoconductor drum in the image forming apparatus shown in FIGS. 1 and 2 (2/2).

Subsequently, the controller 31 determines an applied voltage to the charging roller 21 corresponding to a desired surface potential Vs of the photoconductor drum 1 (in Steps S4 to S7). FIGS. 5 and 6 are timing charts that explain determination of an applied voltage to a charging roller 21 corresponding to a desired surface potential Vs of the photoconductor drum in the image forming apparatus shown in FIGS. 1 and 2.

Firstly, as shown in FIG. 5, the controller 31 sets an alternating current component of the development bias using the development bias power supply circuit 33 so as to make a lowest level VdL of the development bias (i.e. a minimum value of the development bias wave form) equal to a level lower by a discharge voltage Vd0 than a desired surface potential Vs of the photoconductor drum 1 (in Step S4).

Subsequently, as shown in FIG. 6, the controller 31 increases an applied voltage to the charging roller 21 gradually from a predetermined level using the charge power supply circuit 32 (in Step S5).

In this process, when detecting discharge between the photoconductor drum 1 and the developing roller 22 (in Step S6), the controller 31 determines as an applied voltage Vc0 to the charging roller 21 corresponding to the desired surface potential Vs the applied voltage Vc at a timing when the discharge is detected (in Step S7).

Specifically, since the lowest value VdL of the development bias is set so as to be lower by the discharge voltage Vd0 than the desired surface potential Vs of the photoconductor drum 1, applying this applied voltage Vc0 to the charging roller 21 causes a surface potential V of the photoconductor drum 1 at the discharge to be equal to the desired surface voltage Vs (i.e. $V=VdL+Vd0=(Vs-Vd0)+Vd0=Vs$).

In the aforementioned embodiment, the controller 31 (a) increases the development bias using the development bias power supply circuit 33 when a surface potential of the photoconductor drum 1 is 0 Volt, and determines a level of the development bias as a discharge voltage Vd0 when discharge is detected between the photoconductor drum 1 and the developing roller 22, (b) sets an alternating current component of the development bias using the development bias power supply circuit 33 so as to make a lowest level VdL of the development bias equal to a level lower by the discharge voltage Vd0 than a desired surface potential Vs of the photoconductor drum 1, and (c) increases an applied voltage to the charging roller 21 using the charge power supply circuit 32 when applying to the developing roller 22 the development bias of which the alternating current component has been set, and determines as an applied voltage Vc0 to the charging roller 21 corresponding to the desired surface potential Vs, the applied voltage Vc at a timing when discharge is detected between the photoconductor drum 1 and the developing roller 22.

Consequently, without using a surface potential sensor, a surface potential of the photoconductor drum is properly set.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

What is claimed is:

1. An image forming apparatus, comprising:

a photoconductor drum;

a charging roller configured to charge a surface of the photoconductor drum;

a developing roller;

a charge power supply circuit configured to apply a direct current voltage to the charging roller;

a development bias power supply circuit configured to apply a development bias to the developing roller; and a controller configured to control the charge power supply circuit and the development bias power supply circuit;

wherein the controller (a) increases the development bias using the development bias power supply circuit when a surface potential of the photoconductor drum is 0V, and determines a level of the development bias as a discharge voltage at a timing when discharge is detected between the photoconductor drum and the developing roller, (b) sets an alternating current component of the development bias using the development bias power supply circuit so as to make a lowest level of the development bias equal to a difference between a desired surface potential of the photoconductor drum and the discharge voltage, and (c) increases an applied voltage to the charging roller using the charge power supply circuit when applying to the developing roller the development bias of which the alternating current component has been set, and determines as an applied voltage to the charging roller corresponding to the desired surface potential of the photoconductor drum, the applied voltage to the charging roller at a timing when discharge is detected between the photoconductor drum and the developing roller.

2. The image forming apparatus according to claim 1, wherein when the controller increases the development bias, the controller stepwisely increases the development bias each time the developing roller rotates predetermined plural times, and wherein when the controller determines the level of the development bias as the discharge voltage, discharge is detected predetermined plural times between the photoconductor drum and the developing roller.

3. The image forming apparatus according to claim 1, wherein when the controller increases the applied voltage to the charging roller, the controller stepwisely increases the applied voltage to the charging roller each time the developing roller rotates predetermined plural times, and wherein when the controller determines the applied voltage to the charging roller corresponding to the desired surface potential of the photoconductor drum, discharge is detected predetermined plural times between the photoconductor drum and the developing roller.

4. The image forming apparatus according to claim 1, wherein the controller sets a peak-to-peak value of the alternating current component of the development bias or a duty of the alternating current component of the development bias using the development bias power supply circuit so as to make the lowest level of the development bias equal to the difference between the desired surface potential of the photoconductor drum and the discharge voltage.

* * * * *